US008349784B2

(12) United States Patent
Zipfel et al.

(10) Patent No.: US 8,349,784 B2
(45) Date of Patent: Jan. 8, 2013

(54) AUTOMATIC DISHWASHING AGENT

(75) Inventors: Johannes Zipfel, Dusseldorf (DE); Nadine Warkotsch, Dusseldorf (DE); Arnd Kessler, Monheim am Rhein (DE); Christian Nitsch, Dusseldorf (DE); Dorota Sendor-Muller, Dusseldorf (DE); Britta Strauss, Solingen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/151,487

(22) Filed: Jun. 2, 2011

(65) Prior Publication Data

US 2011/0232692 A1 Sep. 29, 2011

Related U.S. Application Data

(63) Continuation of application No. PCT/EP2009/066102, filed on Dec. 1, 2009.

(30) Foreign Application Priority Data

Dec. 5, 2008 (DE) ..... 10 2008 060 471

(51) Int. Cl.
*C11D 17/00* (2006.01)

(52) U.S. Cl. ..... 510/220; 510/226; 510/229; 134/25.1; 134/25.2

(58) Field of Classification Search ..... 510/220, 510/226, 229; 134/25.1, 25.2
See application file for complete search history.

(56) References Cited

U.S. PATENT DOCUMENTS

| | | | | |
|---|---|---|---|---|
| 7,012,052 | B1 | 3/2006 | Kluesener et al. | |
| 7,462,588 | B2 * | 12/2008 | Bayersdoerfer et al. | 510/220 |
| 7,491,686 | B2 * | 2/2009 | Barthel et al. | 510/446 |
| 2008/0255020 | A1 * | 10/2008 | Holderbaum | 510/298 |

FOREIGN PATENT DOCUMENTS

| | | | |
|---|---|---|---|
| DE | 4323252 | C2 | 1/1995 |
| DE | 4327327 | A1 | 2/1995 |
| DE | 19738866 | A1 | 3/1999 |
| EP | 1524313 | B1 | 3/2007 |
| EP | 1682643 | B1 | 8/2007 |
| EP | 1764408 | B1 | 4/2010 |
| WO | WO2008/095563 | A1 | 8/2008 |

OTHER PUBLICATIONS

PCT International Search Report (PCT/EP2009/066102) dated Oct. 2, 2010.

* cited by examiner

*Primary Examiner* — Gregory Webb
(74) *Attorney, Agent, or Firm* — David K. Benson

(57) ABSTRACT

An automatic dishwashing agent includes builder(s), enzyme(s) and a) a nonionic surfactant A of the general formula $R^1O(AlkO)_xM(OAlk)_yOR^2$, in which $R^1$ and $R^2$ mutually independently denote a branched or unbranched, saturated or unsaturated, optionally hydroxylated alkyl residue with 4 to 22 carbon atoms; Alk denotes a branched or unbranched alkyl residue with 2 to 4 carbon atoms; x and y mutually independently denote values between 1 and 70; and M denotes an alkyl residue from the group $CH_2$, $CHR^3$, $CR^3R^4$, $CH_2CHR^3$ and $CHR^3CHR^4$, with $R^3$ and $R^4$ mutually independently denoting a branched or unbranched, saturated or unsaturated alkyl residue with 1 to 18 carbon atoms; b) a nonionic surfactant B which differs from the nonionic surfactant A; and c) an anionic copolymer C. The agent imparts an improved drying and rinsing result.

14 Claims, No Drawings

AUTOMATIC DISHWASHING AGENT

CROSS-REFERENCES TO RELATED APPLICATIONS

This is a continuation of International Application No. PCT/EP2009/066102, filed Dec. 1, 2009, which claims priority to German Patent Application No. DE 10 2008 060 471.2, filed Dec. 5, 2008, both of which are hereby incorporated by reference.

FIELD OF THE INVENTION

The present invention generally relates to automatic dishwashing agents, automatic dishwashing methods using these dishwashing agents and the use of these dishwashing agents for improving drying in automatic dishwashing.

BACKGROUND OF THE INVENTION

Dishwashing agents are available to consumers in numerous presentations. In addition to traditional liquid manual dishwashing agents, automatic dishwashing agents have in particular become increasingly significant as domestic dishwashing machines have become more common. These automatic dishwashing agents are typically offered for sale to the consumer in solid form, for example as a powder or as tablets, but increasingly also in liquid form.

One of the main objectives of manufacturers of automatic cleaning agents is to improve the cleaning and rinsing performance of these agents, increasing attention having been paid in recent times to cleaning performance in low temperature cleaning cycles or in cleaning cycles with reduced water consumption.

Rinsing performance and drying in automatic dishwashing are conventionally improved by using specific rinse aids or substances with a rinsing action which are dispensed in a first presentation separately from the automatic dishwashing agent.

A biodegradable, separately dispensed rinse aid based on specific polyalkoxylates is described, for example, in European Patent EP 1 682 643 B1 (Ecolab).

In a second presentation, the rinse aids or substances with a rinsing action are incorporated into the automatic dishwashing agent ("multiple-in-one" dishwashing agents).

European Patent EP 1 524 313 B1 (Dalli) describes such a cleaning agent composition for automatic dishwashing, into which a specific surfactant is incorporated for improving rinsing characteristics.

Developments in the field of automatic rinse aids are directed, on the one hand, towards the object of improved formulation of the two previously described presentations and, on the other hand, towards the object of provision of more effective rinsing additives or additive combinations.

BRIEF SUMMARY OF THE INVENTION

The above-mentioned objects, and others, are met by an automatic dishwashing agent with reduced film deposition and improved drying and rinsing characteristics, it being intended that these improved drying and rinsing characteristics in particular also be achieved in low temperature cleaning cycles, namely in cleaning methods with washing liquor temperatures of 50° C. or below. Such objects are achieved by using an automatic dishwashing agent which, in addition to a specific surfactant combination, furthermore contains an anionic copolymer from the group of polycarboxylic acids or polysulfonic acids.

Specifically, the above-mentioned objects, and others, are met by an automatic dishwashing agent containing builder(s), enzyme(s), a) a nonionic surfactant A of the general formula $R^1O(AlkO)_xM(OAlk)_yOR^2$, in which
   - $R^1$ and $R^2$ mutually independently denote a branched or unbranched, saturated or unsaturated, optionally hydroxylated alkyl residue with 4 to 22 carbon atoms,
   - Alk denotes a branched or unbranched alkyl residue with 2 to 4 carbon atoms,
   - x and y mutually independently denote values between 1 and 70, and
   - M denotes an alkyl residue from the group $CH_2$, $CHR^3$, $CR^3R^4$, $CH_2CHR^3$ and $CHR^3CHR^4$, with $R^3$ and $R^4$ mutually independently denoting a branched or unbranched, saturated or unsaturated alkyl residue with 1 to 18 carbon atoms;

b) a nonionic surfactant B which differs from the nonionic surfactant A; and c) an anionic polymer C.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The present application provides automatic dishwashing agents. As defined in the present application, automatic dishwashing agents are compositions which may be used for cleaning soiled dishes in an automatic dishwashing method. The automatic dishwashing agents according to the invention thus differ, for example, from automatic rinse aids, which are always used in combination with automatic dishwashing agents and do not themselves carry out any cleaning action. Dishwashing agents according to the invention contain builder(s) and enzyme(s) to provide their cleaning action.

Automatic dishwashing agents according to the invention contain one or more builder(s) as their first component. The proportion by weight of builders in the total weight of automatic dishwashing agents according to the invention preferably amounts to 15 to 80 wt. % and in particular to 20 to 70 wt. %. Builders in particular include carbonates, phosphates, citrates, organic co-builders and silicates.

It is particularly preferred to use carbonate(s) and/or hydrogencarbonate(s), preferably alkali metal carbonate(s), particularly preferably sodium carbonate, in quantities of 2 to 30 wt. %, preferably of 4 to 28 wt. % and in particular of 8 to 24 wt. %, in each case relative to the weight of the automatic dishwashing agent.

It is furthermore preferred to use one or more phosphates. Among the numerous commercially obtainable phosphates, it is the alkali metal phosphates which have the greatest significance in the washing and cleaning agent industry, with pentasodium or pentapotassium triphosphate (sodium or potassium tripolyphosphate) being particularly preferred.

"Alkali metal phosphates" is the summary name for the alkali metal (in particular sodium and potassium) salts of the various phosphoric acids, it being possible to distinguish between meta-phosphoric acids $(HPO_3)_n$ and ortho-phosphoric acid $H_3PO_4$ as well as higher molecular weight representatives. The phosphates here combine a number of advantages, including their ability to act as alkalinity donors, prevent lime deposits on machine parts or lime incrustation of fabrics and, moreover, contribute to cleaning performance.

Phosphates which are particularly preferred according to the invention are pentasodium triphosphate, $Na_5P_3O_{10}$ (sodium tripolyphosphate) and the corresponding potassium salt pentapotassium triphosphate, $K_5P_3O_{10}$ (potassium tripolyphosphate). Sodium potassium tripolyphosphates are also preferably used according to the invention.

If, for the purposes of the present application, phosphates are used as substances with a washing or cleaning action in the automatic dishwashing agents, the latter preferably contain phosphate(s), preferably alkali metal phosphate(s), particularly preferably pentasodium or pentapotassium triphosphate (sodium or potassium tripolyphosphate), in quantities of 5 to 60 wt. %, preferably of 15 to 45 wt. % and in particular of 20 to 40 wt. %, in each case relative to the weight of the automatic dishwashing agent.

Organic cobuilders which may in particular be mentioned are polycarboxylates/polycarboxylic acids, polymeric carboxylates, aspartic acid, polyacetals, dextrins and organic cobuilders. These classes of substances are described below.

Usable organic builder materials are for example polycarboxylic acids usable in the form of the free acid and/or the sodium salts thereof, polycarboxylic acids being taken to mean those carboxylic acids which bear more than one acid function. Examples include citric acid, adipic acid, succinic acid, glutaric acid, malic acid, tartaric acid, maleic acid, fumaric acid, saccharic acids, aminocarboxylic acids, nitrilotriacetic acid (NTA), provided that there are no environmental objections against such use, and mixtures of these. Apart from their builder action, the free acids typically also have the property of an acidifying component and so also serve to establish a lower and gentler pH value for washing or cleaning agents. Citric acid, succinic acid, glutaric acid, adipic acid, gluconic acid and any desired mixtures of these may in particular be mentioned.

Particularly preferred automatic dishwashing agents according to the invention contain citrate as one of their essential builders. Exemplary automatic dishwashing agents are characterized in that they contain 2 to 40 wt. %, preferably 5 to 30 wt. % and in particular 7 to 20 wt. % of citrate.

The citrates, like the phosphates, are preferably used in combination with carbonates and/or hydrogencarbonate. Preferred automatic dishwashing agents are characterized by builder combination of phosphate and carbonate/hydrogencarbonate or of citrate and carbonate/hydrogencarbonate (cf. Tables 1a and 1b below). Builder combinations may, it goes without saying, also be prepared from phosphate, citrate and carbonate/hydrogencarbonate.

Particularly preferred automatic dishwashing agents are characterized in that the dishwashing agent contains at least two builders from the group of phosphates, carbonates and citrates, the proportion by weight of these builders, relative to the total weight of the automatic dishwashing agent, amounting by preference to 5 to 80 wt. %, preferably to 15 to 75 wt. % and in particular to 30 to 70 wt. %. The combination of two or more builders from the above-stated group has proven to be advantageous for the cleaning and rinsing performance of automatic dishwashing agents according to the invention.

Further suitable builders are polymeric polycarboxylates, these being for example the alkali metal salts of polyacrylic acid or polymethacrylic acid, for example those with a relative molecular mass of 500 to 70000 g/mol.

Suitable polymers are in particular polyacrylates, which preferably have a molecular mass of 2000 to 20000 g/mol. Due to their superior solubility, the short-chain polyacrylates from this group may in turn be preferred, these having molar masses of from 2000 to 10000 g/mol, and particularly preferably of from 3000 to 5000 g/mol.

Also suitable are copolymeric polycarboxylates, in particular those of acrylic acid with methacrylic acid and acrylic acid or methacrylic acid with maleic acid. Copolymers of acrylic acid with maleic acid containing 50 to 90 wt. % acrylic acid and 50 to 10 wt. % maleic acid have proven particularly suitable. Their relative molecular mass, relative to free acids, amounts in general to 2000 to 70000 g/mol, preferably 20000 to 50000 g/mol and in particular 30000 to 40000 g/mol.

The content of (co)polymeric polycarboxylates in the automatic dishwashing agents preferably amounts to 0.5 to 20 wt. % and in particular to 3 to 10 wt. %.

Automatic dishwashing agents according to the invention may contain as builder crystalline layered silicates of the general formula $NaMSi_xO_{2x+i}.y\ H_2O$, in which M represents sodium or hydrogen, x is a number from 1.9 to 22, preferably from 1.9 to 4, particularly preferred values for x being 2, 3 or 4, and y denotes a number from 0 to 33, preferably from 0 to 20.

Amorphous sodium silicates may also be used which have a $Na_2O:SiO_2$ modulus of 1:2 to 1:3.3, preferably of 1:2 to 1:2.8 and in particular of 1:2 to 1:2.6, which are preferably dissolution-retarded and exhibit secondary washing characteristics.

In preferred automatic dishwashing agents according to the invention, the content of silicates, relative to the total weight of the automatic dishwashing agent, is restricted to quantities of below 10 wt. %, preferably of below 5 wt. % and in particular of below 2 wt. %. Particularly preferred automatic dishwashing agents according to the invention are silicate-free.

As a complement to the above-stated builders, the agents according to the invention may contain alkali metal hydroxides. These alkalinity donors are preferably used in the cleaning agents in only small quantities, preferably in quantities of below 10 wt. %, preferably of below 6 wt. %, by preference of below 5 wt. %, particularly preferably between 0.1 and 5 wt. % and in particular between 0.5 and 5 wt. %, in each case relative to the total weight of the cleaning agent. Alternative automatic dishwashing agents are free of alkali metal hydroxides.

Some example formulations for preferred automatic dishwashing agents according to the invention may be found in Tables 1a and 1b below:

TABLE 1a

| Ingredient | Formulation 1 [wt. %] | Formulation 2 [wt. %] | Formulation 3 [wt. %] | Formulation 4 [wt. %] |
|---|---|---|---|---|
| Tripolyphosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Enzyme(s) | 0.1 to 15 | 0.1 to 15 | 0.1 to 15 | 0.1 to 15 |
| Nonionic surfactant A[1] | 0.05 to 10 | 0.05 to 10 | 0.05 to 10 | 0.05 to 10 |
| Nonionic surfactant B[2] | 1 to 10 | 1 to 10 | 1 to 10 | 1 to 10 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

TABLE 1b

| Ingredient | Formulation 5 [wt. %] | Formulation 6 [wt. %] | Formulation 7 [wt. %] | Formulation 8 [wt. %] |
|---|---|---|---|---|
| Tripoly-phosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Enzyme(s) | 0.1 to 15 | 0.1 to 15 | 0.1 to 15 | 0.1 to 15 |
| Nonionic surfactant A[1] | 0.1 to 8 | 0.1 to 8 | 0.1 to 8 | 0.1 to 8 |
| Nonionic surfactant B[2] | 2 to 6 | 2 to 6 | 2 to 6 | 2 to 6 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

[1]a nonionic surfactant A of the general formula $R^1O(AlkO)_xM(OAlk)_yOR^2$, in which $R^1$ and $R^2$ mutually independently denote a branched or unbranched, saturated or unsaturated, optionally hydroxylated alkyl residue with 4 to 22 carbon atoms; Alk denotes a branched or unbranched alkyl residue with 2 to 4 carbon atoms; x and y mutually independently denote values between 1 and 70; and M denotes an alkyl residue from the group $CH_2$, $CHR^3$, $CR^3R^4$, $CH_2CHR^3$ and $CHR^3CHR^4$, with $R^3$ and $R^4$ mutually independently denoting a branched or unbranched, saturated or unsaturated alkyl residue with 1 to 18 carbon atoms

[2]a nonionic surfactant B which differs from the nonionic surfactant A

[3]an anionic polymer C from the group of copolymeric polycarboxylates and copolymeric polysulfonates

*"—" means here, as in all following tables, that the formulation is free of this component Dishwashing agents according to the invention contain enzyme(s) as their second component. These include in particular proteases, amylases, lipases, hemicellulases, cellulases, perhydrolases or oxidoreductases, and preferably mixtures thereof. These enzymes are in principle of natural origin; starting from the natural molecules, improved variants are available for use in washing or cleaning agents, said variants accordingly preferably being used. Washing or cleaning agents preferably contain enzymes in total quantities of $1\times10^{-6}$ to 5 wt. % relative to active protein. Protein concentration may be determined with the assistance of known methods, for example the BCA method or the biuret method.

Among proteases, those of the subtilisin type are preferred. Examples of these are subtilisins BPN' and Carlsberg and their further developed forms protease PB92, subtilisins 147 and 309, alkaline protease from *Bacillus lentus*, subtilisin DY and the enzymes thermitase, proteinase K and proteases TW3 and TW7, which are classed among subtilases but no longer among the subtilisins as more narrowly defined.

Examples of amylases usable according to the invention are the α-amylases from *Bacillus licheniformis*, from *B. amyloliquefaciens*, from *B. stearothermophilus*, from *Aspergillus niger* and *A. oryzae* and the further developed forms of the above-stated amylases which have been improved for use in washing and cleaning agents. Particular note should furthermore be taken for this purpose of the α-amylase from *Bacillus* sp. A 7-7 (DSM 12368) and the cyclodextrin glucanotransferase (CGTase) from *B. agaradherens* (DSM 9948).

Lipases or cutinases, in particular because of their triglyceride-cleaving activities, but also in order to produce peracids in situ from suitable precursors may furthermore be used according to the invention. These include, for example, lipases originally obtainable or further developed from *Humicola lanuginosa* (*Thermomyces lanuginosus*), in particular those with the D96L amino acid substitution.

Enzymes which fall within the class of hemicellulases may furthermore be used. These include, for example, mannanases, xanthan lyases, pectin lyases (=pectinases), pectin esterases, pectate lyases, xyloglucanases (=xylanases), pullulanases and β-glucanases.

Oxidoreductases, for example oxidases, oxygenases, catalases, peroxidases, such as halo-, chloro-, bromo-, lignin, glucose or manganese peroxidases, dioxygenases or laccases (phenol oxidases, polyphenol oxidases) may be used according to the invention to increase bleaching action. Compounds, preferably organic compounds, particularly preferably aromatic compounds, which interact with the enzymes are advantageously also added in order to enhance the activity of the oxidoreductases in question (enhancers) or, in the event of a major difference in redox potential between the oxidizing enzymes and the soiling, to ensure electron flow (mediators).

A protein and/or enzyme may be protected, particularly during storage, from damage such as for example inactivation, denaturation or degradation for instance due to physical influences, oxidation or proteolytic cleavage. If the proteins and/or enzymes are isolated from microbes, inhibition of proteolysis is particularly preferred, in particular if the agents also contain proteases. Washing or cleaning agents may contain stabilizers for this purpose; the provision of such agents constitutes a preferred embodiment of the present invention.

Proteases and amylases with a washing or cleaning action are not generally provided in the form of the pure protein but rather in the form of stabilized storable and transportable preparations. These preformulated preparations include, for example, solid preparations obtained by granulation, extrusion or freeze-drying or, in particular in the case of preparations in liquid or gel form, solutions of the enzymes, advantageously as concentrated as possible, with a low water content and/or combined with stabilizers or further auxiliaries.

Alternatively, both for the solid and the liquid presentation, the enzymes may be encapsulated, for example by spray drying or extruding the enzyme solution together with a preferably natural polymer or in the form of capsules, for example those in which the enzymes are enclosed for instance in a solidified gel or those of the core-shell type, in which an enzyme-containing core is coated with a protective layer which is impermeable to water, air and/or chemicals. Further active ingredients, for example stabilizers, emulsifiers, pigments, bleaching agents or dyes may additionally be applied in superimposed layers. Such capsules are applied in accordance with per se known methods, for example by agitated or rolling granulation or in fluidized bed processes. Advantageously, such granules are low-dusting, for example due to the application of polymeric film formers, and stable in storage thanks to the coating.

It is furthermore possible to formulate two or more enzymes together such that a single granular product comprises two or more enzyme activities.

As is clear from the preceding explanations, the enzyme protein constitutes only a fraction of the total weight of conventional enzyme preparations. Protease and amylase preparations preferably used according to the invention contain between 0.1 and 40 wt. %, preferably between 0.2 and 30 wt. %, particularly preferably between 0.4 and 20 wt. % and in particular between 0.8 and 10 wt. % of the enzyme protein.

Preferred automatic dishwashing agents are in particular those which, in each case relative to the total weight thereof, contain 0.1 to 12 wt. %, preferably 0.2 to 10 wt. % and in particular 0.5 to 8 wt. % of enzyme preparations.

Some example formulations for preferred automatic dishwashing agents according to the invention may be found in Tables 2a and 2b below:

TABLE 2a

| Ingredient | Formulation 1 [wt. %] | Formulation 2 [wt. %] | Formulation 3 [wt. %] | Formulation 4 [wt. %] |
|---|---|---|---|---|
| Tripoly-phosphate | 5 to 50 | 15 to 40 | — | — |

TABLE 2a-continued

| Ingredient | Formulation 1 [wt. %] | Formulation 2 [wt. %] | Formulation 3 [wt. %] | Formulation 4 [wt. %] |
|---|---|---|---|---|
| Citrate | —* | — | 5 to 40 | 15 to 30 |
| Carbonate | 2 to 45 | 2 to 35 | 2 to 45 | 2 to 35 |
| Protease ** | 0.2 to 10 | 0.2 to 10 | 0.5 to 8 | 0.5 to 8 |
| Amylase ** | 0.2 to 10 | 0.2 to 10 | 0.5 to 8 | 0.5 to 8 |
| Nonionic surfactant A[1] | 0.05 to 10 | 0.05 to 10 | 0.05 to 10 | 0.05 to 10 |
| Nonionic surfactant B[2] | 1 to 10 | 1 to 10 | 1 to 10 | 1 to 10 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

TABLE 2b

| Ingredient | Formulation 5 [wt. %] | Formulation 6 [wt. %] | Formulation 7 [wt. %] | Formulation 8 [wt. %] |
|---|---|---|---|---|
| Tripoly-phosphate | 5 to 50 | 15 to 40 | — | — |
| Citrate | —* | — | 5 to 40 | 715 to 30 |
| Carbonate | 2 to 45 | 2 to 35 | 2 to 45 | 2 to 35 |
| Protease** | 0.2 to 10 | 0.2 to 10 | 0.5 to 8 | 0.5 to 8 |
| Amylase** | 0.2 to 10 | 0.2 to 10 | 0.5 to 8 | 0.5 to 8 |
| Nonionic surfactant A[1] | 0.1 to 8 | 0.1 to 8 | 0.1 to 8 | 0.1 to 8 |
| Nonionic surfactant B[2] | 2 to 6 | 2 to 6 | 2 to 6 | 2 to 6 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

[1]a nonionic surfactant A of the general formula $R^1O(AlkO)_xM(OAlk)_yOR^2$, in which $R^1$ and $R^2$ mutually independently denote a branched or unbranched, saturated or unsaturated, optionally hydroxylated alkyl residue with 4 to 22 carbon atoms; Alk denotes a branched or unbranched alkyl residue with 2 to 4 carbon atoms; x and y mutually independently denote values between 1 and 70; and M denotes an alkyl residue from the group $CH_2$, $CHR^3$, $CR^3R^4$, $CH_2CHR^3$ and $CHR^3CHR^4$, with $R^3$ and $R^4$ mutually independently denoting a branched or unbranched, saturated or unsaturated alkyl residue with 1 to 18 carbon atoms
[2]a nonionic surfactant B which differs from the nonionic surfactant A
[3]an anionic polymer C from the group of copolymeric polycarboxylatas and copolymeric polysulfonates
*"—" means here, as in all following tables, that the formulation is free of this component
**the stated weights relate to the proportion by weight of the enzyme preparation A first component of the active ingredient combination of nonionic surfactants A and B and anionic polymer, which combination is responsible for the improved drying of automatic dishwashing agents according to the invention, is the nonionic surfactant A of the general formula $R^1O(AlkO)_xM(OAlk)_yOR^2$.

The proportion by weight of the nonionic surfactant A in the total weight of the automatic dishwashing agent according to the invention amounts in a preferred embodiment to between 0.05 and 10 wt. %, preferably between 0.1 and 8 wt. %, by preference between 0.5 and 5 wt. % and in particular between 1 and 3 wt. %.

The group of nonionic surfactants A comprises a range of particularly preferred compounds.

In a first preferred embodiment, automatic dishwashing agents according to the invention contain a surfactant of the general formula $R^1—CH(OH)CH_2—O(CH_2CH_2O)_xCH_2CHR(OCH_2CH_2)_yO—CH_2CH(OH)—R^2$ as nonionic surfactant A, in which

- R, $R^1$ and $R^2$ mutually independently denote an alkyl residue or alkenyl residue with 6 to 22 carbon atoms;
- x and y mutually independently denote values between 1 and 40.

Table 3 below shows some example formulations for preferred automatic dishwashing agents according to the invention:

TABLE 3

| Ingredient | Formulation 1 [wt. %] | Formulation 2 [wt. %] | Formulation 3 [wt. %] | Formulation 4 [wt. %] |
|---|---|---|---|---|
| Tripoly-phosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Enzyme** | 0.2 to 10 | 0.2 to 10 | 0.5 to 8 | 0.5 to 8 |
| Nonionic surfactant A[1] | 0.05 to 10 | 0.05 to 10 | 0.05 to 10 | 0.05 to 10 |
| Nonionic surfactant B[2] | 1 to 10 | 1 to 10 | 1 to 10 | 1 to 10 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

[1]a nonionic surfactant A of the general formula $R^1—CH(OH)CH_2—O(CH_2CH_2O)_xCH_2CHR(OCH_2CH_2)_yO—CH_2CH(OH)—R^2$ is used, in which R, $R^1$ and $R^2$ mutually independently denote an alkyl residue or alkenyl residue with 6 to 22 carbon atoms; and x and y mutually independently denote values between 1 and 40
[2]a nonionic surfactant B which differs from the nonionic surfactant A;
[3]an anionic polymer C from the group of copolymeric polycarboxylates and copolymeric polysulfonates
**the stated weights relate to the proportion by weight of the enzyme preparation Preferred compounds are in particular those of the general formula $R^1—CH(OH)CH_2—O(CH_2CH_2O)_xCH_2CHR(OCH_2CH_2)_yO—CH_2CH(OH)—R^2$, in which R denotes a linear, saturated alkyl residue with 8 to 16 carbon atoms, preferably 10 to 14 carbon atoms and n and m mutually independently have values of 20 to 30. Corresponding compounds may be obtained, for example, by reacting alkyl diols $HO—CHR—CH_2—OH$ with ethylene oxide, this being followed by a reaction with an alkyl epoxide to block off the free OH functions with formation of a dihydroxy ether.

In a further preferred embodiment, automatic dishwashing agents according to the invention contain a surfactant of the general formula $R^1—O(CH_2CH_2O)_xCR^3R^4(OCH_2CH_2)_yO—R^2$ as nonionic surfactant A, in which

- $R^1$ and $R^2$ mutually independently denote an alkyl residue or alkenyl residue with 4 to 22 carbon atoms;
- $R^3$ and $R^4$ mutually independently denote an alkyl residue or alkenyl residue with 1 to 18 carbon atoms; and
- x and y mutually independently denote values between 1 and 40;

Table 4 below shows some example formulations for preferred automatic dishwashing agents according to the invention:

TABLE 4

| Ingredient | Formulation 1 [wt. %] | Formulation 2 [wt. %] | Formulation 3 [wt. %] | Formulation 4 [wt. %] |
|---|---|---|---|---|
| Tripoly-phosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Enzyme** | 0.2 to 10 | 0.2 to 10 | 0.5 to 8 | 0.5 to 8 |
| Nonionic surfactant A[1] | 0.05 to 10 | 0.05 to 10 | 0.05 to 10 | 0.05 to 10 |
| Nonionic surfactant B[2] | 1 to 10 | 1 to 10 | 1 to 10 | 1 to 10 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

[1]a nonionic surfactant A of the general formula $R^1—O(CH_2CH_2O)_xCR^3R^4(OCH_2CH_2)_yO—R^2$ is used, in which $R^1$ and $R^2$ mutually independently denote an alkyl residue or alkenyl residue with 4 to 22 carbon atoms; $R^3$ and $R^4$ mutually independently denote an alkyl residue or alkenyl residue with 1 to 18 carbon atoms and x and y mutually independently denote values between 1 and 40
[2]a nonionic surfactant B which differs from the nonionic surfactant A;
[3]an anionic polymer C from the group of copolymeric polycarboxylates and copolymeric polysulfonates
**the stated weights relate to the proportion by weight of the enzyme preparation Preferred compounds are in particular those of the general formula $R^1—O(CH_2CH_2O)_xCR^3R^4(OCH_2CH_2)_yO—R^2$, in which $R^3$ and $R^4$ denote H and the indices x and y mutually independently assume values of 1 to 40, preferably of 1 to 15.

Particularly preferred compounds are those of the general formula $R^1—O(CH_2CH_2O)_xCR^3R^4(OCH_2CH_2)_yO—R^2$, in which the residues $R^1$ and $R^2$ mutually independently represent saturated alkyl residues with 4 to 14 carbon atoms and the indices x and y mutually independently assume values of 1 to 15 and in particular of 1 to 12.

Preferred compounds are furthermore those of the general formula $R^1—O(CH_2CH_2O)_xCR^3R^4(OCH_2CH_2)_yO—R^2$, in which one of the residues $R^1$ and $R^2$ is branched.

Very particularly preferred compounds are those of the general formula $R^1—O(CH_2CH_2O)_xCR^3R^4(OCH_2CH_2)_yO—R^2$, in which the indices x and y mutually independently assume values of 8 to 12.

The automatic dishwashing agents according to the invention contain a second nonionic surfactant B as a further essential component.

The proportion by weight of the nonionic surfactant in the total weight of the automatic dishwashing agent according to the invention amounts in a preferred embodiment to between 0,1 and 30 wt. %, preferably between 0.5 and 20 wt. %, by preference between 1 and 10 wt. % and in particular between 2 and 6 wt. %.

Preferred nonionic surfactants B are of the general formula $R^1O[CH_2CH(CH_3)O]_x[CH_2CH_2O]_y[CH_2CH(CH_3)O]_z CH_2CH(OH)R^2$, in which $R^1$ denotes a linear or branched aliphatic hydrocarbon residue with 4 to 22 carbon atoms or mixtures thereof, $R^2$ denotes a linear or branched hydrocarbon residue with 2 to 26 carbon atoms or mixtures thereof and x and z denote values between 0 and 40 and y denotes a value of at least 15.

Addition of these nonionic surfactants has proved to be advantageous in particular with regard to rinsing performance and drying. In a preferred embodiment, the automatic dishwashing agent contains, relative to the total weight thereof, nonionic surfactant of the general formula $R^1O[CH_2CH(CH_3)O]_x[CH_2CH_2O]_y[CH_2CH(CH_3)O]_zCH_2CH(OH)R^2$ in quantities of 0.1 to 15 wt. %, preferably of 0.2 to 10 wt. %, particularly preferably of 0.5 to 8 wt. % and in particular of 1.0 to 6 wt. %.

Preferred end group-terminated poly(oxyalkylated) nonionic surfactants are in particular those of the formula $R^1O[CH_2CH_2O]_yCH_2CH(OH)R^2$, in which $R^1$ denotes a linear or branched aliphatic hydrocarbon residue with 4 to 22 carbon atoms or mixtures thereof, $R^2$ denotes a linear or branched hydrocarbon residue with 2 to 26 carbon atoms or mixtures thereof and y denotes a value between 15 and 120, preferably 20 to 100, in particular 20 to 80. The group of these nonionic surfactants includes, for example, hydroxy mixed ethers of the general formula $C_{6-22}—CH(OH)CH_2O-(EO)_{20-120}—C_{2-26}$, for example $C_{8-12}$ fatty alcohol-$(EO)_{22}$-2-hydroxydecyl ethers and $C_{4-22}$ fatty alcohol-$(EO)_{40-80}$-2-hydroxyalkyl ethers.

Automatic dishwashing agents according to the invention which are characterized in that a surfactant of the general formula $R^1CH(OH)CH_2O—(CH_2CH_2O)_{20-120}—R^2$ is used as nonionic surfactant B, with $R^1$ and $R^2$ mutually independently denoting a linear or branched aliphatic hydrocarbon residue with 2 to 20 carbon atoms, are particularly preferred.

Table 5 below shows some example formulations for preferred automatic dishwashing agents according to the invention:

TABLE 5

| Ingredient | Formulation 1 [wt. %] | Formulation 2 [wt. %] | Formulation 3 [wt. %] | Formulation 4 [wt. %] |
|---|---|---|---|---|
| Tripoly-phosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Protease** | 0.2 to 10 | 0.2 to 10 | 0.5 to 8 | 0.5 to 8 |
| Amylase** | 0.2 to 10 | 0.2 to 10 | 0.5 to 8 | 0.5 to 8 |
| Nonionic surfactant A[1] | 0.05 to 10 | 0.05 to 10 | 0.05 to 10 | 0.05 to 10 |
| Nonionic surfactant B[2] | 1 to 10 | 1 to 10 | 1 to 10 | 1 to 10 |
| Anionic copolymer C[3] | 0.5 to 18 | 0.5 to 18 | 0.5 to 18 | 0.5 to 18 |
| Misc. | Ad 100 | Ad 100 | Ad 100 | Ad 100 |

[1]a nonionic surfactant A of the general formula $R^1O(AlkO)_xM(OAlk)_yOR^2$, in which $R^1$ and $R^2$ mutually independently denote a branched or unbranched, saturated or unsaturated, optionally hydroxylated alkyl residue with 4 to 22 carbon atoms; Alk denotes a branched or unbranched alkyl residue with 2 to 4 carbon atoms; x and y mutually independently denote values between 1 and 70; and M denotes an alkyl residue from the group $CH_2$, $CHR^3$, $CR^3R^4$, $CH_2CHR^3$ and $CHR^3CHR^4$, with $R^3$ and $R^4$ mutually independently denoting a branched or unbranched, saturated or unsaturated alkyl residue with 1 to 18 carbon atoms

[2]a nonionic surfactant B of the general formula $R^1CH(OH)CH_2O—(CH_2CH_2O)_{20-120}—R^2$, with $R^1$ and $R^2$ mutually independently denoting a linear or branched aliphatic hydrocarbon residue with 2 to 20 carbon atoms

[3]an anionic polymer C from the group of copolymeric polycarboxylates and copolymeric polysulfonates

**the stated weights relate to the proportion by weight of the enzyme preparation Preferred surfactants are furthermore those of the formula $R^1O[CH_2CH(CH_3)O]_x[CH_2CH_2O]_yCH_2CH(OH)R^2$, in which $R^1$ denotes a linear or branched aliphatic hydrocarbon residue with 4 to 22 carbon atoms or mixtures thereof, $R^2$ denotes a linear or branched hydrocarbon residue with 2 to 26 carbon atoms or mixtures thereof and x denotes values between 0.5 and 4, preferably 0.5 to 1.5, and y denotes a value of at least 15.

Surfactants which are preferred according to the invention are furthermore also those of the general formula $R^1O[CH_2CH(CH_3)O]_x[CH_2CH_2O]_yCH_2CH(OH)R^2$, $R^1$ denoting a linear or branched aliphatic hydrocarbon residue with 4 to 22 carbon atoms or mixtures thereof, $R^2$ a linear or branched hydrocarbon residue with 2 to 26 carbon atoms or mixtures thereof and X a value between 1 and 40 and y a value between 15 and 40, the alkylene units $[CH_2CH(CH_3)O]$ and $[CH_2CH_2O]$ being present randomly, i.e. in the form of a statistical, chance distribution.

The group of preferred end group-terminated poly(oxyalkylated) nonionic surfactants B furthermore includes those of the formula B furthermore includes those of the formula $R^1O[CH_2CH_2O],[CH_2CH(R^3)O]_yCH_2CH(OH)R^2$, in which $R^1$ and $R^2$ mutually independently denote a linear or branched, saturated or mono- or polyunsaturated hydrocarbon residue with 2 to 26 carbon atoms, $R^3$ is mutually independently selected from $—CH_3$, $—CH_2CH_3$, $—CH_2CH_2—CH_3$, $—CH(CH_3)_2$, but preferably denotes $—CH_3$, and x and y mutually independently denote values between 1 and 32, with nonionic surfactants with $R^3$=$—CH_3$ and values for x of 15 to 32 and y of 0.5 and 1.5 being very particularly preferred.

Thanks to the use of the above-described nonionic surfactants with a free hydroxyl group on one of the two terminal alkyl residues, it is possible to achieve a distinct improvement in rinsing performance and drying in comparison with conventional polyalkoxylated fatty alcohols without a free hydroxyl group.

The stated C chain lengths and degrees of ethoxylation or degrees of alkoxylation of the above-stated nonionic surfactants are statistical averages which, for a specific product, may be an integer or a fractional number. Due to production methods, commercial products of the stated formulae do not in the main consist of an individual representative, but instead of mixtures, whereby not only the C-chain lengths but also the degrees of ethoxylation or degrees of alkoxylation may be averages and consequently fractional numbers.

The above-stated nonionic surfactants may, of course, be used not only as individual substances, but also as surfactant mixtures of two, three, four or more surfactants. Surfactant mixtures do not here comprise mixtures of nonionic surfactants all of which fall within one of the above-stated general formulae, but instead such mixtures which contain two, three, four or more nonionic surfactants which may be described by various of the above-stated or other general formulae.

In particular, nonionic surfactants b) having a melting point of above room temperature are preferred. Nonionic surfactant(s) b) with a melting point of above 20° C., preferably of above 25° C., particularly preferably of between 25 and 60° C. and in particular of between 26.6 and 43.3° C., is/are particularly preferred.

With regard to optimizing the rinsing and drying performance achievable by means of the automatic dishwashing agents according to the invention, advantageous automatic dishwashing agents have proven to be those in which the weight ratio of nonionic surfactant A to nonionic surfactant B is between 0.05:1 and 1:2, preferably between 0.1:1 and 1:1.5 and in particular between 0.2:1 and 1:1.

The automatic dishwashing agents according to the invention contain an anionic polymer C as a further essential component. Preferred anionic copolymers are copolymeric polycarboxylates and copolymeric polysulfonates.

The proportion by weight of the copolymeric anionic polymer C in the total weight of the automatic dishwashing agent according to the invention amounts in a preferred embodiment to between 0.1 and 20 wt. %, preferably between 0.5 and 18 wt. %, by preference between 1.0 and 15 wt. % and in particular between 4 and 14 wt. %.

Automatic dishwashing agents according to the invention which are characterized in that the copolymeric anionic polymer C is selected from the group of hydrophobically modified polycarboxylates and polysulfonates are particularly preferred, since the hydrophobic modification of the anionic copolymers can bring about an improvement in the rinsing and drying characteristics of these agents simultaneously combined with slight film deposition.

Particularly preferred automatic dishwashing agents according to the invention include a) 0.5 to 5 wt.% of a nonionic surfactant A of the general formula $R^1—CH(OH)CH_2—O(CH_2CH_2O)_xCH_2CHR(OCH_2CH_2)_yO—CH_2CH(OH)—R^2$, in which
   R, $R^1$ and $R^2$ mutually independently denote an alkyl residue or alkenyl residue with 6 to 22 carbon atoms, and
   x and y mutually independently denote values between 1 and 40;
b) 1 to 10 wt. % of a nonionic surfactant B which differs from the nonionic surfactant A; and
c) 1 to 15 wt. % of a copolymeric anionic polymer C from the group of hydrophobically modified polycarboxylates and polysulfonates.

Further preferred automatic dishwashing agents according to the invention contain a) 0.5 to 5 wt. % of a nonionic surfactant A of the general formula $R^1—O(CH_2CH_2O)_xCH_2(OCH_2CH_2)_yO—R^2$, in which
   $R^1$ and $R^2$ mutually independently denote an alkyl residue or alkenyl residue with 4 to 22 carbon atoms, and
   x and y mutually independently denote values between 1 and 40;
b) 1 to 10 wt. % of a nonionic surfactant B which differs from the nonionic surfactant A; and
c) 1 to 15 wt. % of a copolymeric anionic polymer C from the group of hydrophobically modified polycarboxylates and polysulfonates.

The copolymers C may comprise two, three, four or more different monomer units.

Preferred copolymeric polysulfonates C contain, in addition to monomer(s) containing sulfonic acid groups, at least one monomer from the group of unsaturated carboxylic acids.

The unsaturated carboxylic acid(s) used with particular preference are unsaturated carboxylic acids of the formula $R^1(R^2)C{=}C(R^3)COOH$, in which $R^1$ to $R^3$ mutually independently denote —H, $—CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with $—NH_2$, —OH or —COOH as defined above or denote —COOH or $—COOR^4$, with $R^4$ being a saturated or unsaturated, straight-chain or branched hydrocarbon residue with 1 to 12 carbon atoms.

Particularly preferred unsaturated carboxylic acids are acrylic acid, methacrylic acid, ethacrylic acid, α chloroacrylic acid, α cyanoacrylic acid, crotonic acid, α phenylacrylic acid, maleic acid, maleic anhydride, fumaric acid, itaconic acid, citraconic acid, methylenemalonic acid, sorbic acid, cinnamic acid or mixtures thereof. Unsaturated dicarboxylic acids may, of course, also be used.

Preferred monomers containing sulfonic acid groups are those of the formula $$R^5(R^6)C{=}C(R^7)—X—SO_3H$$

in which $R^5$ to $R^7$ mutually independently denote —H, $—CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with $—NH_2$, —OH or —COOH or denote —COOH or $—COOR^4$, with $R^4$ being a saturated or unsaturated, straight-chain or branched hydrocarbon residue with 1 to 12 carbon atoms, and X denoting an optionally present spacer group which is selected from $—(CH_2)_n—$ with n=0 to 4, $—COO—(CH_2)_k—$ with k=1 to 6, $—C(O)—NH—C(CH_3)_2—$ and $—C(O)—NH—CH(CH_2CH_3)—$.

Preferred among these monomers are those of the formulae $$H_2C{=}CH—X—SO_3H$$

$$H_2C{=}C(CH_3)—X—SO_3H$$

$$HO_3S—X—(R^6)C{=}C(R^7)—X—SO_3H,$$

in which $R^6$ and $R^7$ are mutually independently selected from —H, $—CH_3$, $—CH_2CH_3$, $—CH_2CH_2CH_3$, $—CH(CH_3)_2$ and X denotes an optionally present spacer group which is selected from $—(CH_2)_n—$ with n=0 to 4, $—COO—(CH_2)_k-$ with k=1 to 6, $—C(O)—NH—C(CH_3)_2—$ and $—C(O)—NH—CH(CH_2CH_3)—$.

Particularly preferred monomers containing sulfonic acid groups are here 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethacrylamide, sulfomethylmethacrylamide and mixtures of the stated acids or the water-soluble salts thereof The sulfonic acid groups may be present in the polymers entirely or in part in neutralized form, i.e. the acidic hydrogen atom of the sulfonic acid group may be replaced in some or all of the sulfonic acid groups with metal ions, preferably alkali metal ions and in particular with sodium ions. It is preferred according to the invention to use copolymers containing partially or completely neutralized sulfonic acid groups.

In those copolymers solely containing monomers from groups i) and ii), the monomer distribution of the copolymers preferably used according to the invention preferably amounts in each case to 5 to 95 wt. % of i) or ii), particularly preferably 50 to 90 wt. % of monomer from group ii) and 10 to 50 wt. % of monomer from group i), in each case relative to the polymer.

The molar mass of the sulfo copolymers preferably used according to the invention may be varied in order to tailor the properties of the polymers to the desired intended application. Preferred automatic dishwashing agents are characterized in that the copolymers have molar masses of 2000 to 200,000 $gmol^{-1}$, preferably of 4000 to 25,000 $gmol^{-1}$ and in particular of 5000 to 15,000 $gmol^{-1}$.

In a further preferred embodiment, in addition to a monomer containing carboxyl groups and a monomer containing sulfonic acid groups, the copolymers C further comprise at least one nonionic, preferably hydrophobic monomer. It has in particular been possible to improve the rinsing performance of automatic dishwashing agents according to the invention by using these hydrophobically modified polymers.

Automatic dishwashing agents which are characterized in that the automatic dishwashing agent contains as anionic polymer b) a copolymer comprising i) monomer(s) containing carboxylic acid groups ii) monomer(s) containing sulfonic acid groups iii) nonionic monomer(s)

are preferred according to the invention.

Preferably used nonionic monomers are those of the general formula $R^1(R^2)C{=}C(R^3)—X—R^4$, in which $R^1$ to $R^3$ mutually independently denote —H, $—CH_3$ or $—C_2H_5$, X denotes an optionally present spacer group which is selected from $—CH_2—$, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms.

Particularly preferred nonionic monomers are butene, isobutene, pentene, 3-methylbutene, 2-methylbutene, cyclopentene, hexene, 1-hexene, 2-methyl-1-pentene, 3 -methyl-1 -pentene, cyclohexene, methylcyclopentene, cycloheptene, methylcyclohexene, 2,4,4-trimethyl-1-pentene, 2,4,4-trimethyl-2-pentene, 2,3 -dimethyl-1 -hexene, 2,4-dimethyl-1-hexene, 2,5-dimethyl-1-hexene, 3,5 -dimethyl-1 -hexene, 4,4-dimethyl- 1 -hexane, ethylcyclohexyne, 1-octene, α-olefins with 10 or more carbon atoms such as for example 1-decease, 1-dodecene, 1-hexadecene, 1-octadecene and C22-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl)acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl)acrylamide, behenyl acrylate, behenyl methacrylate and N-(behenyl)acrylamide or mixtures thereof.

Some example formulations for preferred automatic dishwashing agents according to the invention may be found in Tables 6a and 6b below:

TABLE 6a

| Ingredient | Formulation 1 [wt. %] | Formulation 2 [wt. %] | Formulation 3 [wt. %] | Formulation 4 [wt. %] |
|---|---|---|---|---|
| Tripolyphosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Nonionic surfactant $A^{1a}$ | 0.05 to 10 | 0.05 to 10 | 0.05 to 10 | 0.05 to 10 |
| Nonionic surfactant $B^2$ | 1 to 10 | 1 to 10 | 1 to 10 | 1 to 10 |
| Anionic copolymer $C^3$ | 0.5 to 18 | 0.5 to 18 | 0.5 to 18 | 0.5 to 18 |
| Misc. | Ad 100 | Ad 100 | Ad 100 | Ad 100 |

TABLE 6b

| Ingredient | Formulation 1 [wt. %] | Formulation 2 [wt. %] | Formulation 3 [wt. %] | Formulation 4 [wt. %] |
|---|---|---|---|---|
| Tripolyphosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Nonionic surfactant $A^{1b}$ | 0.05 to 10 | 0.05 to 10 | 0.05 to 10 | 0.05 to 10 |
| Nonionic surfactant $B^2$ | 1 to 10 | 1 to 10 | 1 to 10 | 1 to 10 |
| Anionic copolymer $C^3$ | 0.5 to 18 | 0.5 to 18 | 0.5 to 18 | 0.5 to 18 |
| Misc. | Ad 100 | Ad 100 | Ad 100 | Ad 100 |

[1a] a nonionic surfactant A of the general formula $R—CH(OH)CH_2—O(CH_2CH_2O)_xCH_2CHR(OCH_2CH_2)_yO—CH_2CH(OH)—R^2$ is used, in which R, $R^1$ and $R^2$ mutually independently denote an alkyl residue or alkenyl residue with 6 to 22 carbon atoms, and; x and y mutually independently denote values between 1 and 40

[1b] a nonionic surfactant A of the general formula $R^1—O(CH_2CH_2O)_xCR^3R^4(OCH_2CH_2)_yO—R^2$ is used, in which $R^1$ and $R^2$ mutually independently denote an alkyl residue or alkenyl residue with 4 to 22 carbon atoms,; $R^3$ and $R^4$ mutually independently denote an alkyl residue or alkenyl residue with 1 to 18 carbon atoms, and x and y mutually independently denote values between 1 and 40

[2] a nonionic surfactant B which differs from the nonionic surfactant A;

[3] an anionic polymer C comprising i) monomer(s) containing carboxylic acid groups ii) monomer(s) containing sulfonic acid groups iii) nonionic monomer(s)

In addition to the previously described ingredients, the agents according to the invention may contain further substances with a washing or cleaning action, preferably from the group of bleaching agents, bleach activators and bleach catalysts, glass corrosion inhibitors, corrosion inhibitors, scents and perfume carriers. These preferred ingredients are described in greater detail below.

Automatic dishwashing agents according to the invention may contain a bleaching agent as a further component, oxygen bleaching agents being preferred. Among those compounds acting as bleaching agents which release $H_2O_2$ in water, sodium percarbonate, sodium perborate tetrahydrate and sodium perborate monohydrate are of particular significance. Further usable bleaching agents are, for example, peroxypyrophosphates, citrate perhydrates and $H_2O_2$-releasing per-acidic salts or per-acids, such as perbenzoates, peroxophthalates, diperazelaic acid, phthaloimino per-acid or diperdodecanedioic acid.

Bleaching agents from the group of organic bleaching agents may furthermore also be used. Typical organic bleaching agents are diacyl peroxides, such as for example dibenzoyl peroxide. Further typical organic bleaching agents are peroxy acids, with examples which may in particular be mentioned being alkylperoxy acids and arylperoxy acids.

Preferred automatic dishwashing agents according to the invention are characterized in that they contain an oxygen bleaching agent, preferably sodium percarbonate, particularly preferably a coated sodium percarbonate. The proportion by weight of the bleaching agent, relative to the total weight of the washing or cleaning agent, amounts in preferred embodiments to between 2 and 30 wt. %, preferably between 4 and 20 wt. % and in particular between 6 and 15 wt. %.

The automatic dishwashing agents according to the invention may contain bleach activators as bleach activators. Under perhydrolysis conditions, these compounds yield aliphatic peroxycarboxylic acids with preferably 1 to 10 carbon atoms, in particular 2 to 4 carbon atoms, and/or optionally substituted perbenzoic acid. Suitable substances are those which bear O- and/or N-acyl groups having the stated number of C atoms and/or optionally substituted benzoyl groups. Polyacylated alkylenediamines are preferred, tetraacetylethylenediamine (TAED) having proved particularly suitable.

Automatic dishwashing agents which are characterized in that they contain bleach activator a bleach activator from the group of acetylated amines, preferably tetraacetylethylenediamine (TAED), are preferred according to the invention. These bleach activators, in particular TAED, are preferably used in quantities of up to 10 wt. %, in particular of 0.1 wt. % to 10 wt. %, particularly of 0.5 to 8 wt. % and particularly preferably of 1.0 to 6 wt. %.

Additionally or alternatively to the conventional bleach activators, the automatic dishwashing agents according to the invention preferably contain at least one bleach catalyst. These substances comprise bleach-boosting transition metal salts or transition metal complexes such as for example Mn, Fe, Co, Ru or Mo salen complexes or carbonyl complexes. Mn, Fe, Co, Ru, Mo, Ti, V and Cu complexes with nitrogenous tripod ligands and Co, Fe, Cu and Ru ammine complexes may also be used as bleach catalysts.

Complexes of manganese in oxidation state II, III, IV or IV which preferably contain one or more macrocyclic ligand(s) with N, NR, PR, O and/or S donor functions are particularly preferentially used. Ligands which comprise nitrogen donor functions are preferably used. It is here particularly preferred to use bleach catalyst(s) in the agents according to the invention which contain 1,4,7-trimethyl-1,4,7-triazacyclononane (Me-TACN), 1,4,7-triazacyclononane (TACN), 1 ,5,9-trimethyl-1,5,9-triazacyclododecane (Me-TACD), 2-methyl-1,4,7-trimethyl -1,4,7-triazacyclononane (Me/Me-TACN) and/or 2-methyl-1,4,7-triazacyclononane (Me/TACN) as the macromolecular ligand. Suitable manganese complexes are for example $[Mn^{III}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}_4(\mu\text{-}O)_6(TACN)_4](ClO_4)_4$, $[Mn^{III}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}_2(\mu\text{-}O)_3(Me\text{-}TACN)_2](PF_6)_2$ and $[Mn^{IV}_2(\mu\text{-}O)_3(Me/Me\text{-}TACN)_2](PF_6)_2(OAc{=}OC(O)CH_3)$.

Automatic dishwashing agents which are characterized in that they furthermore contain a bleach catalyst selected from the group of bleach-boosting transition metal salts and transition metal complexes, preferably from the group of complexes of manganese with 1,4,7-trimethyl-1,4,7-triazacyclononane ($Me_3$-TACN) or 1,2,4,7-tetramethyl-1,4,7-triazacyclononane ($Me_4$-TACN), are preferred according to the invention since the above-stated bleach catalysts can bring about a significant improvement in particular in the cleaning result.

The above-stated bleach-boosting transition metal complexes, in particular with Mn and Co central atoms,, are used in conventional quantities, preferably in a quantity of up to 5 wt. %, in particular of 0.0025 wt. % to 1 wt. % and particularly preferably of 0.01 wt. % to 0.30 wt. %, in each case relative to the total weight of the agents containing bleach catalyst. In specific cases, however, more bleach catalyst may also be used.

Some example formulations for preferred automatic dishwashing agents according to the invention may be found in Tables 7a and 7b below:

TABLE 7a

| Ingredient | Formulation 1 [wt. %] | Formulation 2 [wt. %] | Formulation 3 [wt. %] | Formulation 4 [wt. %] |
|---|---|---|---|---|
| Tripolyphosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Nonionic surfactant $A^{1a}$ | 0.05 to 10 | 0.05 to 10 | 0.05 to 10 | 0.05 to 10 |
| Nonionic surfactant $B^2$ | 1 to 10 | 1 to 10 | 1 to 10 | 1 to 10 |
| Anionic copolymer $C^3$ | 0.5 to 18 | 0.5 to 18 | 0.5 to 18 | 0.5 to 18 |
| Sodium percarbonate | 2 to 30 | 2 to 30 | 4 to 20 | 4 to 20 |
| Bleach catalyst | 0 to 2 | 0.0025 to 1 | 0 to 2 | 0.0025 to 1 |
| Misc. | Ad 100 | Ad 100 | Ad 100 | Ad 100 |

TABLE 7b

| Ingredient | Formulation 1 [wt. %] | Formulation 2 [wt. %] | Formulation 3 [wt. %] | Formulation 4 [wt. %] |
|---|---|---|---|---|
| Tripolyphosphate | 5 to 50 | 15 to 40 | — | — |
| Citrate | —* | — | 5 to 40 | 15 to 30 |
| Carbonate | 2 to 45 | 2 to 35 | 2 to 45 | 2 to 35 |
| Nonionic surfactant $A^{1b}$ | 0.05 to 10 | 0.05 to 10 | 0.05 to 10 | 0.05 to 10 |
| Nonionic surfactant $B^2$ | 1 to 10 | 1 to 10 | 1 to 10 | 1 to 10 |
| Anionic copolymer $C^3$ | 0.5 to 18 | 0.5 to 18 | 0.5 to 18 | 0.5 to 18 |
| Sodium percarbonate | 2 to 30 | 2 to 30 | 4 to 20 | 4 to 20 |

TABLE 7b-continued

| Ingredient | Formulation 1 [wt. %] | Formulation 2 [wt. %] | Formulation 3 [wt. %] | Formulation 4 [wt. %] |
|---|---|---|---|---|
| Bleach catalyst | 0 to 2 | 0.0025 to 1 | 0 to 2 | 0.0025 to 1 |
| Misc. | Ad 100 | Ad 100 | Ad 100 | Ad 100 |

[1a]a nonionic surfactant A of the general formula $R^1$—CH(OH)$CH_2$—O($CH_2CH_2O$)$_x$$CH_2$CHR($OCH_2CH_2$)$_y$O—$CH_2$CH(OH)—$R^2$ is used, in which R, $R^1$ and $R^2$ mutually independently denote an alkyl residue or alkenyl residue with 6 to 22 carbon atoms; x and y mutually independently denote values between 1 and 40

[1b]a nonionic surfactant A of the general formula $R^1$—O($CH_2CH_2O$)$_x$$CR^3R^4$($OCH_2CH_2$)$_y$O—$R^2$ is used, in which $R^1$ and $R^2$ mutually independently denote an alkyl residue or alkenyl residue with 4 to 22 carbon atoms; $R^3$ and $R^4$ mutually independently denote an alkyl residue or alkenyl residue with 1 to 18 carbon atoms and x and y mutually independently denote values between 1 and 40

[2]a nonionic surfactant B which differs from the nonionic surfactant A;

[3]an anionic polymer C comprising i) monomer(s) containing carboxylic acid groups ii) monomer(s) containing sulfonic acid groups iii) nonionic monomer(s).

The automatic dishwashing agents according to the invention may assume presentation forms known to a person skilled in the art, thus for example not only as solid or liquid forms but also as combination solid and liquid presentations.

Suitable solid presentations are in particular powders, granules, extrudates or compacted products, in particular tablets. The liquid presentations based on water and/or organic solvents may be thickened, assuming gel form.

Agents according to the invention may be formulated as monophasic or multiphasic products. Preferred automatic dishwashing agents are in particular those with one, two, three or four phases. Automatic dishwashing agents which are characterized in that they assume the form of a prefabricated dispensing unit with two or more phases are particularly preferred.

The individual phases of multiphasic agents may be of identical or different states of aggregation. Preferred automatic dishwashing agents are in particular those which comprise at least two different solid phases and/or at least two liquid phases and/or at least one solid and at least one liquid phase. Bi- or multiphasic tablets are particularly preferred, for example bilayer tablets, in particular bilayer tablets with a recess and a molding located in the recess.

Automatic dishwashing agents according to the invention are preferably preformulated as dispensing units. These dispensing units preferably comprise the quantity of substances with a washing or cleaning action required for a washing operation. Preferred dispensing units have a weight of between 12 and 30 g, preferably of between 14 and 26 g and in particular of between 15 and 22 g.

The volume of the above-stated dispensing units and their three-dimensional shape are particularly preferentially selected such that the preformulated units can be dispensed by means of the dispensing chamber of a dishwashing machine. The volume of the dispensing unit therefore preferably amounts to between 10 and 35 ml, preferably between 12 and 30 ml and in particular between 15 and 25 ml.

The automatic dishwashing agents according to the invention, in particular the prefabricated dispensing units, particularly preferentially comprise a water-soluble covering.

Disintegration of the prefabricated moldings may be facilitated by incorporating disintegration auxiliaries or "tablet disintegrants" into these agents in order to shorten disintegration times.

These substances, known as disintegrants due to their mode of action, increase in volume on exposure to water, resulting, on the one hand, in an increase of their own volume (swelling) and, on the other hand, possibly also in generation of pressure due to the release of gases, causing the tablet to break up into smaller particles. Disintegration auxiliaries which have long been known are for example carbonate/citric acid systems, it also being possible to use other organic acids. Swelling disintegration auxiliaries are for example synthetic polymers such as polyvinylpyrrolidone (PVP) or natural polymers or modified natural materials such as cellulose and starch and the derivatives thereof, alginates or casein derivatives.

Disintegration auxiliaries are preferably used in quantities of 0.5 to 10 wt. %, preferably of 3 to 7 wt. % and in particular of 4 to 6 wt. %, in each case relative to the total weight of the agent containing the disintegration auxiliary.

Preferably used disintegration agents are those based on cellulose, such that preferred washing or cleaning agents contain such a cellulose-based disintegration agent in quantities of 0.5 to 10 wt. %, preferably of 3 to 7 wt. % and in particular of 4 to 6 wt. %. The cellulose used as a disintegration auxiliary is preferably not used in finely divided form, but is instead converted into a coarser form, for example is granulated or compacted, before being mixed into the premixes which are to be pressed. The particle sizes of such disintegration agents are for the most part above 200 μm, at least 90 wt. % preferably being between 300 and 1600 μm and in particular at least 90 wt. % being between 400 and 1200 μm.

Preferred disintegration auxiliaries, preferably a cellulose-based disintegration auxiliary, preferably in granular, cogranulated or compacted form, are present in the agent containing the disintegration agent in quantities of 0.5 to 10 wt. %, preferably of 3 to 7 wt. % and in particular of 4 to 6 wt. %, in each case relative to the total weight of the agent containing the disintegration agent.

Gas-evolving effervescent systems may furthermore preferably be used according to the invention as tablet disintegration auxiliaries. Preferred effervescent systems, however, consist of at least two components which react together with formation of gas, for example of alkali metal carbonate and/or hydrogencarbonate and an acidifying agent which is suitable for releasing carbon dioxide from the alkali metal salts in aqueous solution. An acidifying agent which releases carbon dioxide from the alkali metal salts in aqueous solution is for example citric acid.

The previously described active ingredient combinations are in particular suitable for cleaning dishes in automatic dishwashing methods. The present application further provides a method of cleaning dishes in a dishwashing machine using an automatic dishwashing agent according to the invention, the automatic dishwashing agent preferably being dispensed into the interior of a dishwashing machine during the performance of a dishwashing program, before the start of the main washing cycle or in the course of the main washing cycle. Dispensing or introduction of the agent according to the invention into the interior of the dishwashing machine may proceed manually, but the agent is preferably dispensed into the interior of the dishwashing machine by means of the dispensing chamber of the dishwashing machine. Preferably, no additional water softener and no additional rinse aid is dispensed into the interior of the dishwashing machine in the course of the cleaning method. The present application also provides a kit for a dishwashing machine, comprising a) an automatic dishwashing agent according to the invention; and b) instructions which instruct the consumer to use the automatic dishwashing agent without addition of a rinse aid and/or a water-softening salt.

The automatic dishwashing agents according to the invention in particular also exhibit their advantageous cleaning and drying characteristics in low temperature cleaning methods. Preferred dishwashing methods using agents according to the invention are therefore characterized in that the dishwashing methods are carried out at a liquor temperature of below 60° C., preferably of below 50° C.

As described above, agents according to the invention are distinguished by improved drying performance in comparison with conventional automatic dishwashing agents. The present application accordingly also provides the use of an automatic dishwashing agent according to the invention for improving drying in automatic dishwashing.

EXAMPLES

In order to demonstrate the improved drying action of dishwashing agents according to the invention, the drying performance of various dishwashing agents of different composition was determined.

To this end, after addition of a defined quantity of soiling, a machine load of dishes, comprising porcelain, glass, plastics and stainless steel, was washed in a dishwashing machine (Bosch SGS 57M82; 50° standard cycle without intensive drying) with 20 g of the automatic dishwashing agents listed in the following table at a water hardness of 21 German hardness degrees. The dishwashing agents were dispensed during the main washing cycle of the dishwashing method.

| | Comp. 1 [wt. %] | Comp. 2 [wt. %] | Comp. 3 [wt. %] | Inv. 1 [wt. %] | Inv. 2 [wt. %] |
|---|---|---|---|---|---|
| Potassium tripolyphosphate | 37 | 37 | 37 | 37 | 37 |
| Nonionic surfactant A[1] | — | 6.1 | 2.0 | 2.0 | 2.0 |
| Nonionic surfactant B[2] | 6.1 | — | 4.0 | 4.0 | 4.0 |
| Anionic copolymer[3] | 8.0 | 8.0 | — | 8.0 | — |
| Anionic copolymer[4] | — | — | — | — | 8.0 |
| Sodium percarbonate | 14.0 | 14.0 | 14.0 | 14.0 | 14.0 |
| TAED | 2.5 | 2.5 | 2.5 | 2.5 | 2.5 |
| Sodium carbonate | 20 | 20 | 20 | 20 | 20 |
| Protease | 2.6 | 2.6 | 2.6 | 2.6 | 2.6 |
| Amylase | 0.7 | 0.7 | 0.7 | 0.7 | 0.7 |
| Phosphonate | 1.4 | 1.4 | 1.4 | 1.4 | 1.4 |
| Water, misc. | Ad 100 | Ad 100 | Ad 100 | Ad 100 | Ad 100 |

[1] $R^1$—CH(OH)$CH_2$—O($CH_2CH_2O$)$_x$$CH_2$CHR($OCH_2CH_2$)$_y$O—$CH_2$CH(OH)—$R^2$ in which R, $R^1$ and $R^2$ mutually independently denote an alkyl residue or alkenyl residue with 6 to 22 carbon atoms, and x and y mutually independently denote values between 1 and 40

[2] hydroxy mixed ether of the general formula $C_{6-22}$—CH(OH)$CH_2$O—$(EO)_{20-120}$—$C_{2-26}$

[3] anionic copolymer from the group of copolymeric polysulfonates

[4] anionic copolymer from the group of copolymeric hydrophobically modified polysulfonates The drying index was determined 30 minutes after the end of the dishwashing method, the door of the dishwashing machine remaining closed during this 30 minute period.

The maximum value for best drying is 0, while poorest drying is rated 6.0.

Film deposition was determined together with the drying index.

The results of the test are stated in the following table and are means calculated from three tests:

| | Comp. 1 | Comp. 2 | Comp. 3 | Inv. 1 | Inv. 2 |
|---|---|---|---|---|---|
| Porcelain | 4.5 | 4.5 | 1.5 | 3.0 | 1.5 |
| Glass | 2.0 | 5.4 | 1.5 | 2.0 | 1.5 |
| Plastics | 6.0 | 2.9 | 0.8 | 4.5 | 0.5 |
| Stainless steel | 1.5 | 3.9 | 0.7 | 1.0 | 1.5 |
| Film deposition | good | good | unsatisfactory | good | good |

It may be concluded from these results that the drying performance of an automatic dishwashing agent may be distinctly improved by using a surfactant combination according to the invention. Further improvement on the basis of this surfactant system may be achieved by the simultaneous addition of a hydrophobically modified polysulfonic acid.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An automatic dishwashing agent comprising, a) at least one builder;

b) at least one enzyme;

c) a nonionic surfactant A of the general formula $R^1O(AlkO)_xM(OAlk)_yOR^2$, wherein $R^1$ and $R^2$ mutually independently denote a branched or unbranched, saturated or unsaturated, optionally hydroxylated alkyl residue with 4 to 22 carbon atoms, Alk denotes a branched or unbranched alkyl residue with 2 to 4 carbon atoms, x and y mutually independently denote values between 1 and 70, and M denotes an alkyl residue from the group $CH_2$, $CHR^3$, $CR^3R^4$, $CH_2CHR^3$ and $CHR^3CHR^4$, with $R^3$ and $R^4$ mutually independently denoting a branched or unbranched, saturated or unsaturated alkyl residue with 1 to 18 carbon atoms;

d) a nonionic surfactant B which differs from the nonionic surfactant A; and e) an anionic copolymer C.

2. The automatic dishwashing agent according to claim 1, wherein the nonionic surfactant A comprises a surfactant of the general formula $R^1$—CH(OH)$CH_2$—O($CH_2CH_2O$)$_x$$CH_2$CHR($OCH_2CH_2$)$_y$O—$CH_2$CH(OH)—$R^2$, wherein R, $R^1$ and $R^2$ mutually independently denote an alkyl residue or alkenyl residue with 6 to 22 carbon atoms, and x and y mutually independently denote values between 1 and 40.

3. The automatic dishwashing agent according to claim 1, wherein the nonionic surfactant A comprises a surfactant of the general formula $R^1—O(CH_2CH_2O)_xCH_2(OCH_2CH_2)_yO—R^2$, wherein $R^1$ and $R^2$ mutually independently denote an alkyl residue or alkenyl residue with 4 to 22 carbon atoms, and x and y mutually independently denote values between 1 and 40.

4. The automatic dishwashing agent according to claim 1, wherein the nonionic surfactant A is included in the automatic dishwashing agent at a concentration ranging between 0.05 and 10 wt. %.

5. The automatic dishwashing agent according to claim 1, wherein the nonionic surfactant B comprises a surfactant of the general formula $R^1CH(OH)CH_2O—(CH_2CH_2O)_{20-120}—R^2$, wherein $R^1$ and $R^2$ mutually independently denote a linear or branched aliphatic hydrocarbon residue with 2 to 20 carbon atoms.

6. The automatic dishwashing agent according to claim 1, wherein the nonionic surfactant B is included in the dishwashing agent at a concentration ranging between 0.1 and 30 wt. %.

7. The automatic dishwashing agent according to claim 1, wherein the copolymeric anionic polymer C is selected from the group of hydrophobically modified polycarboxylates and polysulfonates.

8. The automatic dishwashing agent according to claim 1, wherein the copolymeric anionic polymer C is selected from the group of copolymers comprising:

i) monomer(s) containing carboxylic acid groups ii) monomer(s) containing sulfonic acid groups iii) nonionic monomer(s).

9. The automatic dishwashing agent according to claim 1, wherein copolymeric anionic polymer C is included in the dishwashing agent at a concentration ranging between 0.1 and 20 wt. %.

10. The automatic dishwashing agent according to claim 1, wherein a) the nonionic surfactant A is included in the automatic dishwashing agent at a concentration ranging between 0.5 to 5 wt. %, and the nonionic surfactant A has the general formula $R^1—CH(OH)CH_2—O(CH_2CH_2O)_xCH_2CHR(OCH_2CH_2)_yO—CH_2CH(OH)—R^2$, wherein R, $R^1$ and $R^2$ mutually independently denote an alkyl residue or alkenyl residue with 6 to 22 carbon atoms, and x and y mutually independently denote values between 1 and 40;

b) the nonionic surfactant B is included in the automatic dishwashing agent at a concentration ranging between 1 to 10 wt. %, and the nonionic nonionic surfactant B differs from the nonionic surfactant A; and c) the copolymeric anionic polymer C is included in the automatic dishwashing agent at a concentration ranging between 1 to 15 wt. %, and the copolymeric anionic polymer C is selected from the group of hydrophobically modified polycarboxylates and polysulfonates.

11. The automatic dishwashing agent according to claim 1, wherein a) the nonionic surfactant A is included in the automatic dishwashing agent at a concentration ranging between 0.5 to 5 wt. %, and the nonionic surfactant A has the general formula $R^1—O(CH_2CH_2O)_xCH_2(OCH_2CH_2)_yO—R^2$, wherein $R^1$ and $R^2$ mutually independently denote an alkyl residue or alkenyl residue with 4 to 22 carbon atoms, and x and y mutually independently denote values between 1 and 40;

b) the nonionic surfactant B is included in the automatic dishwashing agent at a concentration ranging between 1 to 10 wt. %, and the nonionic surfactant B differs from the nonionic surfactant A; and c) the nonionic surfactant C is included in the automatic dishwashing agent at a concentration ranging between 1 to 15 wt. %, and the copolymeric anionic polymer C is selected from the group of hydrophobically modified polycarboxylates and polysulfonates.

12. A method for cleaning dishes in a dishwashing machine, comprising the step of: cleaning the dishes using the dishwashing machine together with the automatic dishwashing agent according to claim 1.

13. The method according to claim 12, wherein the dishwashing method is carried out at a liquor temperature of below 60° C.

14. The method according to claim 13, wherein the dishwashing method is carried out at a liquor temperature of below 50° C.

* * * * *